US007832452B2

(12) United States Patent
Deschênes

(10) Patent No.: US 7,832,452 B2
(45) Date of Patent: Nov. 16, 2010

(54) LATH BREAKER

(75) Inventor: Jean Deschênes, Roberval (CA)

(73) Assignee: 9098-9617 Quebec Inc., Chambord, Quebec (CA)

( * ) Notice: Subject to any disclaimer, the term of this patent is extended or adjusted under 35 U.S.C. 154(b) by 979 days.

(21) Appl. No.: 11/410,089

(22) Filed: Apr. 25, 2006

(65) Prior Publication Data

US 2007/0256758 A1 Nov. 8, 2007

(51) Int. Cl.
*B27C 1/00* (2006.01)

(52) U.S. Cl. ..... 160/123

(58) Field of Classification Search ..... 144/1.1, 144/2.1, 3.1, 363, 378, 379; 83/409, 719; 209/517, 521, 651; 198/861.6, 804, 793, 198/701; 414/460, 495, 523, 528, 789.9, 414/795.7, 797.2, 331.02, 331.05, 331.04, 414/187; 118/39, 40; 225/103
See application file for complete search history.

(56) References Cited

U.S. PATENT DOCUMENTS 2,928,559 A * 3/1960 Mosely ..... 414/789.5
3,578,183 A * 5/1971 Larger ..... 414/293
3,633,732 A * 1/1972 Russell et al. ..... 53/500
3,775,953 A * 12/1973 Poutsma ..... 56/126
3,861,261 A * 1/1975 Maxey ..... 83/387
4,090,618 A * 5/1978 Lehmann ..... 414/789.5
4,349,998 A * 9/1982 Covert ..... 53/53
4,372,725 A * 2/1983 Moore et al. ..... 414/460
4,427,330 A * 1/1984 Carter ..... 414/795.7
4,488,478 A * 12/1984 Leeper ..... 99/330
4,927,322 A * 5/1990 Schweizer et al. ..... 414/794.7
4,976,047 A * 12/1990 Galloway et al. ..... 33/735
5,092,730 A * 3/1992 Neri ..... 414/331.04
5,307,940 A * 5/1994 Kanegae ..... 209/517
6,189,679 B1 * 2/2001 Grinder ..... 198/419.1
6,662,535 B2 * 12/2003 Pin ..... 53/556
7,055,672 B2 * 6/2006 Holmgren ..... 198/444

* cited by examiner

*Primary Examiner*—Dana Ross
*Assistant Examiner*—Jennifer Chiang
(74) *Attorney, Agent, or Firm*—Ogilvy Renault LLP

(57) ABSTRACT

An apparatus is disclosed for removing exceeding portions of laths use to separate pieces of lumber in a bundle. The apparatus comprises an external cage and an internal cage having a skeleton framework mounted to the external cage and displaceable between a retracted position and an extended position in which the internal cage projects forwardly from a front open face of the external cage. A chain-like member carrying a plurality of paddles is provided at a front face of the skeleton framework and is driven by a motor for causing the paddles to strike and break the exceeding portions of the laths.

6 Claims, 3 Drawing Sheets

LATH BREAKER

TECHNICAL FIELD

The invention relates generally to an apparatus for breaking laths and, more particularly, to an apparatus suited for removing the exceeding portions of laths in a bundle or stack of lumber pieces.

BACKGROUND OF THE ART

It is well known to use wood or lumber separator, commonly referred to as "lath", "sticker" "crosser", to separate pieces of lumber in a bundle or stack and allow air to flow between layers of lumber and moisture to escape from the wood.

Side-by-side laths or separators typically extend transversely to the length of the pieces of lumbers in the stack. An individual stack is often built up to a height of about 5 feet with the pieces of lumber laid in a spaced and parallel relationship in courses, course upon course, with separators laid between at least some of the courses across the pieces of lumber. The laths often extend beyond one peripheral side of the bundle, thereby interfering with the subsequent wrapping or bagging of the bundle.

SUMMARY OF THE INVENTION

It is therefore an object of this invention to provide an apparatus for removing the exceeding portions of the laths and, thus, facilitate subsequent processing of the bundles.

In one aspect, the present invention provides an apparatus for removing an exceeding portion of a lath used to separate pieces of lumber in a bundle, the exceeding portion extending beyond the periphery of the bundle, the apparatus comprising: an external cage, the external cage having a front open face, and an internal cage having a skeleton framework mounted to the external cage and displaceable between a retracted position and an extended position in which the internal cage projects forwardly from said front open face of said external cage, an upstanding chain-like member carried at a front face of the skeleton framework, a motor for driving the chain-like member, and a plurality of lath breaking paddles mounted to the chain-like member. The chain like-member can include one or more chains. Alternatively, it could be provided as a belt or the like. The chain-like member could also take other forms suited for carrying the paddles along a loop.

In a second aspect, the present invention provides an apparatus for removing an exceeding portion of a lath used to separate pieces of lumber in a bundle, the exceeding portion extending beyond the periphery of the bundle, the apparatus comprising: a plurality of lath breaking paddles rigidly mounted to at least one rotary member journaled to a reciprocating structure mounted to a frame for movement toward and away from the bundle, and a motor for driving the rotary member. The term "rotary member" is herein intended to encompass any revolving part to which the paddles could be mounted. It could, for instance, take the form of a wheel, a chain, a belt, or a combination thereof. This is not intended to be a complete list of the possible alternatives. Also various ways are contemplated to reciprocate the rotary member. The structure supporting the rotary member could, for instance, be displaced by a pneumatic or hydraulic piston and cylinder arrangement. Other types of actuators could be used as well.

In a third aspect, the present invention provides a method for removing an exceeding portion of a lath used to separate pieces of lumber in a bundle, the exceeding portion extending beyond the periphery of the bundle, the method comprising: advancing the bundle to a lath breaking station and striking the exceeding portion of the lath with a striking tool at said lath breaking station with sufficient force to break the exceeding portion away from the remaining portion of the lath. The striking tool can take various forms as long as it is adapted to strike the exceeding portion of the lath and break it away. For instance, it can take the form of a paddle, a hammer, a bat or any other implements that can be used to hit and break the exceeding portion of the lath.

Further details of these and other aspects of the present invention will be apparent from the detailed description and figures included below.

DESCRIPTION OF THE DRAWINGS

Reference is now made to the accompanying figures depicting aspects of an embodiment of the present invention, in which.

DETAILED DESCRIPTION OF THE PREFERRED EMBODIMENTS

Figure 1:
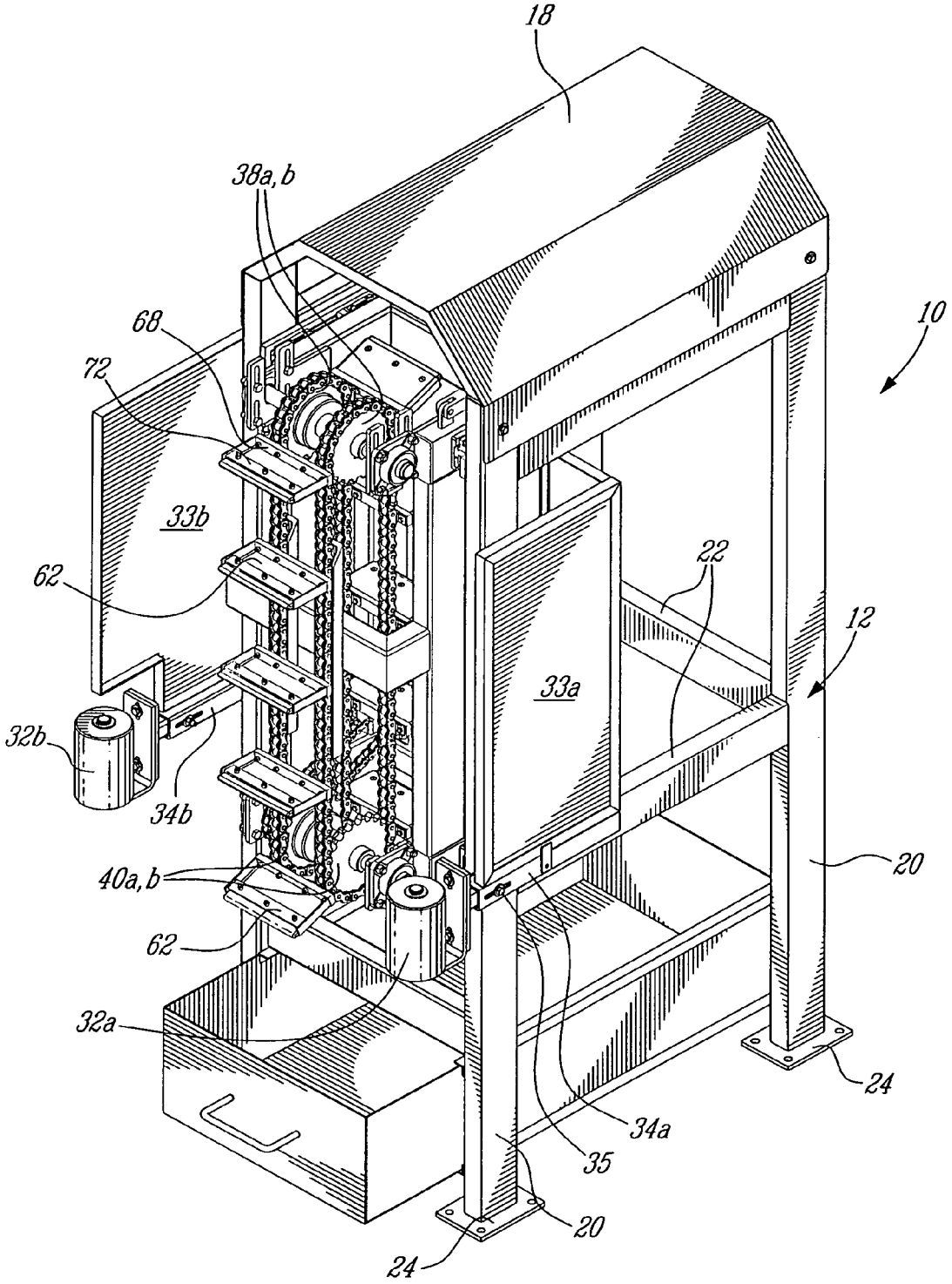
FIG. 1 is a perspective view of a lath breaker in accordance with an embodiment of the present invention.
Figure 2:
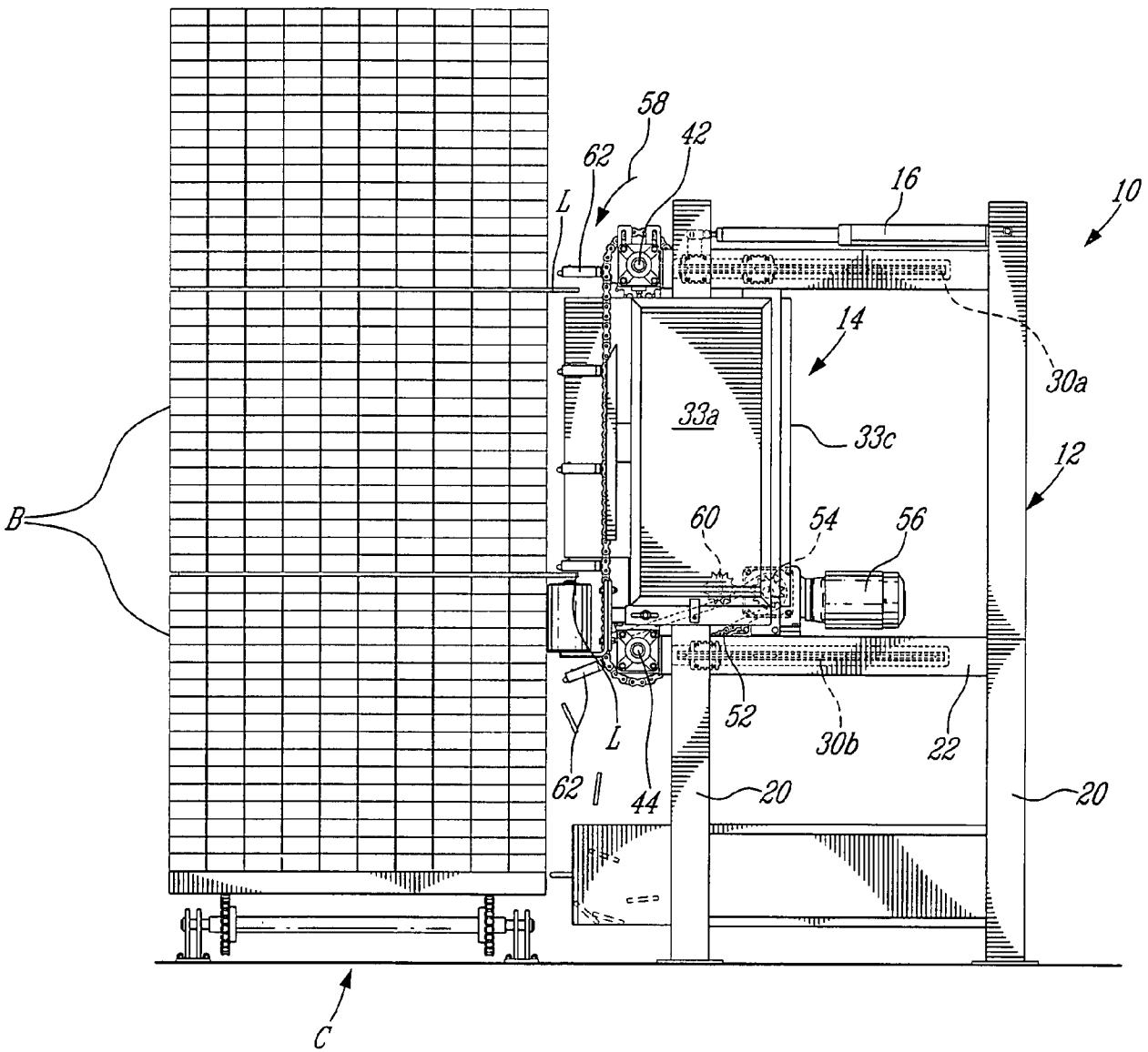
FIG. 2 is a side elevation view of the lath breaker shown in the process of breaking the exceeding portions of a rectangular bundle of laths.

FIGS. 1 and 2 illustrate a lath breaker 10 for breaking the exceeding portions of the laths L used as spacers in a stack or bundle of lumber pieces or the like.

The lath breaker 10 generally comprises a main rectangular frame 12 or external cage, and an internal cage 14 mounted to the main frame 12 for linear movement between a retracted position and an extended position (FIG. 2) through the operation of an actuator, such as a pneumatic cylinder 16 (see FIG. 2) extending between the internal cage 14 and the frame 12. A cover 18 is bolted on top of the main frame 12 to shelter the internal cage 14.

The main frame 12 preferably includes four upstanding corner posts 20 connected to each other by a suitable number of horizontal tubular side members 22. Each corner post 20 is provided at a lower end thereof with a mounting flange 24 for allowing the frame 12 to be bolted to the floor on one lateral side of a conveyor C (FIG. 2) adapted to carry the successive bundles B having laths L to be trimmed.

Figure 3:
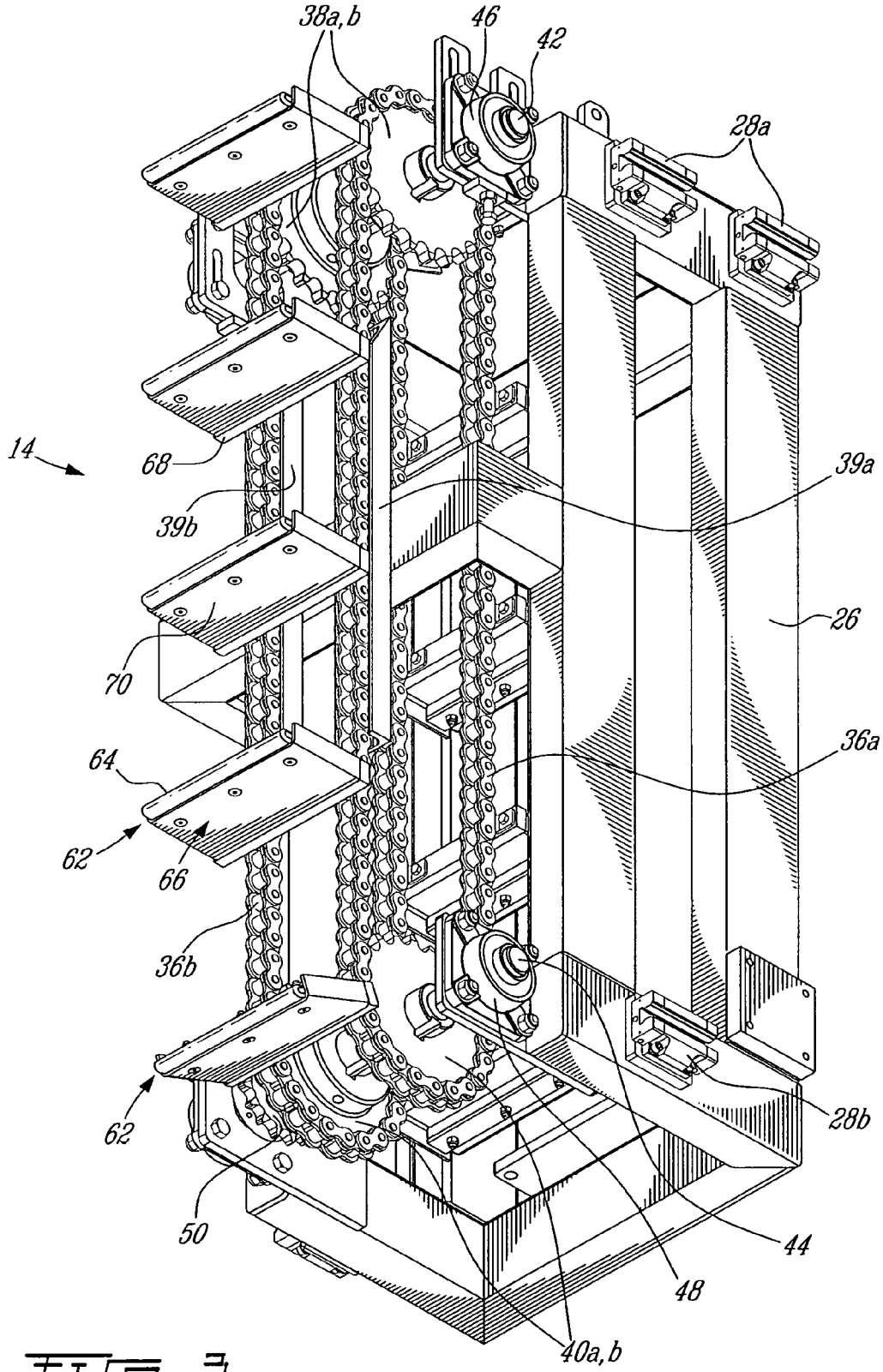
FIG. 3 is a perspective view of an internal cage of the lath breaker.

As shown in FIG. 3, the internal cage 14 has a rectangular skeleton framework 26, which is provided on each side thereof with two upper carriers 28*a* and one lower carrier 28*b* for slidable engagement with corresponding upper and lower rails 30*a* and 30*b* (FIG. 2) mounted to the internal face of the tubular side members 22 provided on the inlet and outlet sides of the main frame 12 and extending between the front and back corner posts 20 thereof. Accordingly, the internal cage 14 can be pulled into the main frame 12 towards the rear end thereof or pushed out of the frame 12 through the front open face thereof by operation of pneumatic cylinder 16.

As shown in FIG. 1, inlet and outlet rollers 32*a*, 32*b* are mounted at the front distal end of respective arms 34*a* and 34*b* extending along opposed sides of the internal cage 14. The arms 34*a* and 34*b* are securely mounted to the internal cage 14 by means of bolts or the like. The arms 34*a* and 34*b* are preferably telescopic in order to provide for adjustment of the length thereof. A suitable locking mechanism 35 is provided to lock the respective telescopic portions of the arms in various relative positions. The rollers 32*a* and 32*b* are mounted for rotation about a vertical axis and disposed for engaging a side portion of the incoming bundle B below the laths L. The role of the rollers 32*a* and 32*b* is to properly position the internal cage 14 relative to the bundle B for the lath breaking operation. When the rollers 32*a* and 32*b* engage the bundle B, the stroke of the pneumatic cylinder 16 is stopped in order to immobilise the internal cage 14 at the right position relative to the bundle to permit the subsequent breaking of the exceeding portions the spacing laths extending laterally outwardly from the side of the bundle facing the lath breaker 10.

As shown in FIG. 1, an inlet safety guard 33*a* and an outlet safety guard 33*b* extend along opposed sides of the internal cage 14 to protect the technician operating the lath breaker 10 from being injured by the exceeding lath portions that are being broken away from the bundles B. As shown in FIG. 2, a rear safety guard 33*c* is also provided at the back of the internal cage 14.

As shown in FIG. 3, the internal cage 14 further comprises a pair of laterally disposed chains 36*a* and 36*b* extending over respective upper and lower sprocket wheels 38*a*, 38*b* and 40*a*, 40*b*. The chains 36*a* and 36*b* run into respective vertical guides 39*a*, 39*b* provided on the front face of the skeleton framework 26. The upper sprocket wheels 38*a*, 38*b* and the lower sprocket wheels 40*a*, 40*b* are respectively keyed to an upper shaft 42 and a lower shaft 44. The upper shaft 42 is journaled at opposed ends thereof to the skeleton framework via a pair of bearings 46 mounted at the front upper end of the framework 26. Likewise, the lower shaft 44 is journaled at opposed ends thereof to the framework via a pair of bearings 48 mounted at the front lower end of the skeleton framework 26. A third sprocket wheel 50 is securely mounted to the lower shaft 44 and is engaged with a transmission chain 52 (FIG. 2) which is, in turn, engaged with a sprocket wheel 54 provided at the output of an electric motor 56. The motor 56 is mounted to the rear portion of the skeleton framework 26 of the internal cage 14 and is operational for driving the lower shaft 44 and, thus, the side-by-side chains 36*a* and 36*b* in the direction indicated by arrow 58 in FIG. 2. As best shown in FIG. 2, a toothed wheel 60 is mounted to the skeleton framework 26 outwardly of the loop defined by the transmission chain 52. The toothed wheel 60 is engaged with the transmission chain 52 to maintain a proper tension therein. The toothed wheel 60 acts as a tensor for the transmission chain 52.

A plurality of lath breaking paddles 62 (ten in the illustrated example) are rigidly mounted to chains 36*a*, 36*b*. The paddles 62 are uniformly distributed along the chains 36*a* and 36*b*. Each paddle 62 is secured along the rear edge thereof to both chains 36*a* and 36*b*. The paddles 62 extend substantially at right angles from the chains 36*a* and 36*b*. Each paddle 62 comprises a ½"×½" striking plate 64 extending from the front end of a metal casing 66. The striking plate 64 is preferably removable and made of a rigid non-marking material, like white Teflon, in order not to leave any marks on the side of the bundle B. The casing 66 includes a back plate 68, a base plate 70 extending from the back plate 68 and having opposed lateral side portions folded upwardly at right angles and a top securing strip 72 (FIG. 1) extending inwardly between the upwardly folded portion of the base plate 70 at a front end thereof. The securing strip 72 and the base plate 70 define a front open gap for receiving the striking plate 64. Bolts or the like extends through the base plate 70, the striking plate 64 and the securing strip 72 to provide a rigid paddle assembly.

In operation, the bundle B is conveyed to the lath breaker 10. The pneumatic cylinder 16 is actuated to displace the internal cage 14 towards the bundle B until the rollers 32*a*, 32*b* engage the side of the bundle B. The motor 56 jointly drives the chains 36*a* and 36*b* in rotation to cause the paddles 62 to strike the exceeding portions of the laths L in a descending direction. The exceeding portions of the laths L are broken away from the remaining portion of the laths L under the force of the paddles.

The above description is meant to be exemplary only, and one skilled in the art will recognize that changes may be made to the embodiments described without department from the scope of the invention disclosed. Such modifications are intended to fall within the appended claims.

What is claimed is:

1. An apparatus for breaking-off an exceeding portion of a lath used to separate pieces of lumber in a bundle carried on a conveyor extending in front of the apparatus, the exceeding portion extending beyond the periphery of the bundle, the apparatus comprising:

an external cage, said external cage having a front open face, and an internal cage having a skeleton framework mounted to the external cage and displaceable relative to the external cage between a retracted position and an extended position in which the internal cage projects forwardly from said front open lace of said external cage, a vertical chain member carried at a front face of said skeleton framework, a motor for driving said chain member, and a plurality of lath breaking paddles substantially uniformly distributed along said chain member, the lath breaking paddles projecting substantially at right angles from the chain, member, a bundle localization aid projecting from the skeleton framework forwardly beyond the lath breaking paddles to stop the skeleton framework at an appropriate distance from the bundle carried on a conveyor in front of the apparatus for allowing said lath breaking paddles to strike and break-off the exceeding portion of the lath used to separate pieces of lumber in a bundle, the exceeding portion extending beyond the periphery of the bundle, and an actuator for displacing the skeleton framework of the internal cage towards the bundle until the bundle localization aid engages the bundle, thereby positioning said skeleton framework in said extended position with the lath breaking paddles extending forwardly out of the front open face of the external cage.

2. The apparatus as defined in claim 1, wherein said bundle localization aid comprises a pair of rollers mounted at a front distal end of respective forwardly extending arms provided on opposed sides of the skeleton framework.

3. The apparatus as defined in claim 1, wherein the chain like member comprises a pair of side-by-side chains running over respective top and bottom sprocket wheels.

4. The apparatus as defined in claim 3, wherein longitudinal guides are provided at the front face of the skeleton framework to prevent lateral deviation of the chains.

5. The apparatus as defined in claim 1, wherein a carrier and rail assembly is provided between the external cage and the internal cage.

6. The apparatus as defined in claim 1, wherein each lath breaking paddle has a front removable lip made of a non-marking material.

* * * * *